US005161556A

United States Patent [19]

Audebourg et al.

[11] Patent Number: 5,161,556

[45] Date of Patent: Nov. 10, 1992

[54] MAKE-UP BOX

[75] Inventors: Jean Audebourg, Choisy-le-Roi; Gerard Lecerf, Saint-Maur; Robert Petit, Paray-Vieille-Poste, all of France

[73] Assignee: LIR France, Chevilly-Larue, France

[21] Appl. No.: 487,293

[22] Filed: Mar. 2, 1990

[30] Foreign Application Priority Data

Mar. 3, 1989 [FR] France ..... 89 02818

[51] Int. Cl.[5] ..... A45D 33/22

[52] U.S. Cl. ..... 132/296; 132/301; 132/304; 206/581; 206/823

[58] Field of Search ..... 132/301, 303, 300, 293, 132/294, 295, 296, 304; 206/581, 823

[56] References Cited

U.S. PATENT DOCUMENTS

| | | | |
|---|---|---|---|
| 1,653,293 | 12/1927 | Kendall | 132/315 |
| 1,760,015 | 5/1930 | Schwabe | 132/301 |
| 2,089,834 | 8/1937 | Kasdan et al. | 132/295 |
| 3,911,936 | 10/1975 | Kingsford | 132/301 |
| 4,162,010 | 7/1979 | Hovsepian | 206/229 |
| 4,388,935 | 6/1983 | Napolitane | 132/294 |
| 4,421,127 | 12/1983 | Geer | 132/294 |
| 4,474,196 | 10/1984 | Yuhara | 132/301 |
| 4,526,273 | 7/1985 | Tsuji et al. | 132/286 |
| 4,684,017 | 8/1987 | Watanabe et al. | 206/581 |
| 4,826,014 | 5/1989 | Schefer | 132/303 |
| 4,863,034 | 9/1989 | Contreras et al. | 206/581 |

FOREIGN PATENT DOCUMENTS

| | | | |
|---|---|---|---|
| 1503866 | 10/1967 | France . | |
| 2600240 | 6/1987 | France . | |
| 2156784 | 10/1985 | United Kingdom | 206/823 |
| 2197640 | 5/1988 | United Kingdom | 206/823 |

*Primary Examiner*—John J. Wilson
*Assistant Examiner*—Frank A. LaViola
*Attorney, Agent, or Firm*—Owen, Wickersham & Erickson

[57] ABSTRACT

Make-up box comprising a case (1) constructed of two case parts (2,3) articulated one on the other, a mirror (8) being arranged in a first (2) case part and a platform (9) bearing one or more make-up products on one of its faces being arranged in the second (3) case part. The second case part (3) is at least partially transparent and the platform (9) is arranged so as to be movable and rotatable through 180° in the said second case part (3) so as to be able to occupy two positions such that the make-up products supported by the platform may be turned towards the second case part (3) in a first position and turned towards the first case part (2) in the second position.

20 Claims, 2 Drawing Sheets

MAKE-UP BOX

The present invention relates to a make-up box comprising a case constructed of two case parts articulated one on the other, a mirror being arranged in a first of the said parts and a platform bearing one or more make-up products on one of its faces being arranged in the second of the said case parts.

In known make-up boxes of this type, the platform which is the support bearing the make-up products is generally permanently fixed in the second case part in a manner such that the make-up products are turned, when the box is closed, towards the first case part bearing the mirror on its inside face. The main drawback of these make-up boxes, the two case parts of which are generally opaque, is that they do not allow customers, when the said boxes are displayed for sale without being open, to view the contents of the box and in particular the shades of the make-up products.

Moreover there are make-up boxes the case part forming the lid of which is constructed of transparent material which makes it possible to see, through the lid, the contents of the other case part forming the bottom of the case. However, of necessity, in this case, the case part forming the cover cannot exhibit a mirror. Now, the presence of a mirror in a make-up box is very desirable, even indispensable.

The present invention relates to a make-up box which may be of simple manufacture and inexpensive and which, while overcoming the drawbacks of known make-up boxes, may both be equipped with a mirror and make it possible, when it is displayed for sale, to see the contents of the box without opening said box.

In the make-up box in accordance with the invention comprising a case constructed of two case parts articulated one on the other, a mirror being arranged in a first of the said case parts and a platform bearing one or more make-up products on one of its faces being arranged in the second of the said parts, the said second case part is at least partially transparent and the said platform is arranged so as to be movable and rotatable through 180° in the said second case part so as to be able to occupy two positions such that the make-up products supported by the platform may be turned towards the said second case part in a first position and turned towards the said first case part in a second position.

Hence, in the first position of the platform which corresponds to the position of presentation or display for sale, the make-up products contained in the box are visible through the at least partially transparent second case part thus forming the lid. Hence, without having to open the box, customers may have a perfect view of the contents of the box and thus freely choose the product which suits them. Subsequently, after first use of the box, it is sufficient to pull out the platform from the at least partially transparent second case part and, after rotation through 180°, to reintroduce it in the same case part. Said second case part which formed the lid in the position of presentation for sale hence becomes the bottom in position of use and the first case part bearing the mirror which was the bottom in the position of presentation for sale then becomes the lid. The box may then be used exactly in the same manner as customary boxes with a mirror, that is to say, by opening the box, the make-up products are presented on the bottom of the case and the mirror is on the lid of the case.

Although, within the scope of the invention, the platform bearing the make-up products may be arranged in any movable and rotatable manner whatsoever in the second case part, it is advantageous that the platform and second case part exhibit additional means for rectilinear guidance enabling the platform to slide in its plane over the second case part. Said additional guidance means may preferably be constructed of grooves provided on the platform and tongues provided on the second case part, or vice versa.

According to another feature of the invention, the platform and the case comprise means for immobilizing the platform in relation to the second case part.

Said immobilization means prevent any displacement of the platform in relation to the second case part, in either of the two possible positions of the platform on the second case part.

Said immobilization means may advantageously be constructed of locking means.

Said locking means may preferably be designed so as to allow releasable locking of the platform in the first position or the position of display for sale and non-releasable locking in the second position or position of use.

According to a preferred embodiment of the invention, the guidance means extend from the side of articulation of the two case parts one on the other towards the opposite side of the case and the locking means comprise a locking means releasable by opening of the case when the platform is in the first position.

Preferably, means are also provided on the case and/or on the platform to facilitate pulling out the platform from the case, in the first position.

With reference to the attached diagrammatic drawings, an illustrative and non-limiting embodiment of a make-up box according to the invention will be described below in more detail. In the drawings.

Figure 1:
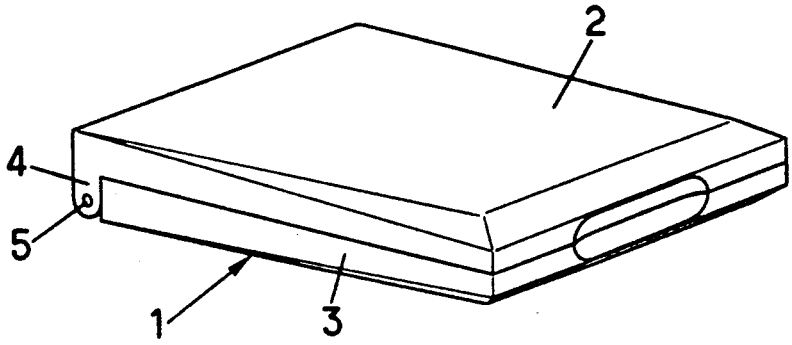
FIG. 1 shows a perspective view of a make-up box in accordance with the invention in the closed position.
Figure 2:
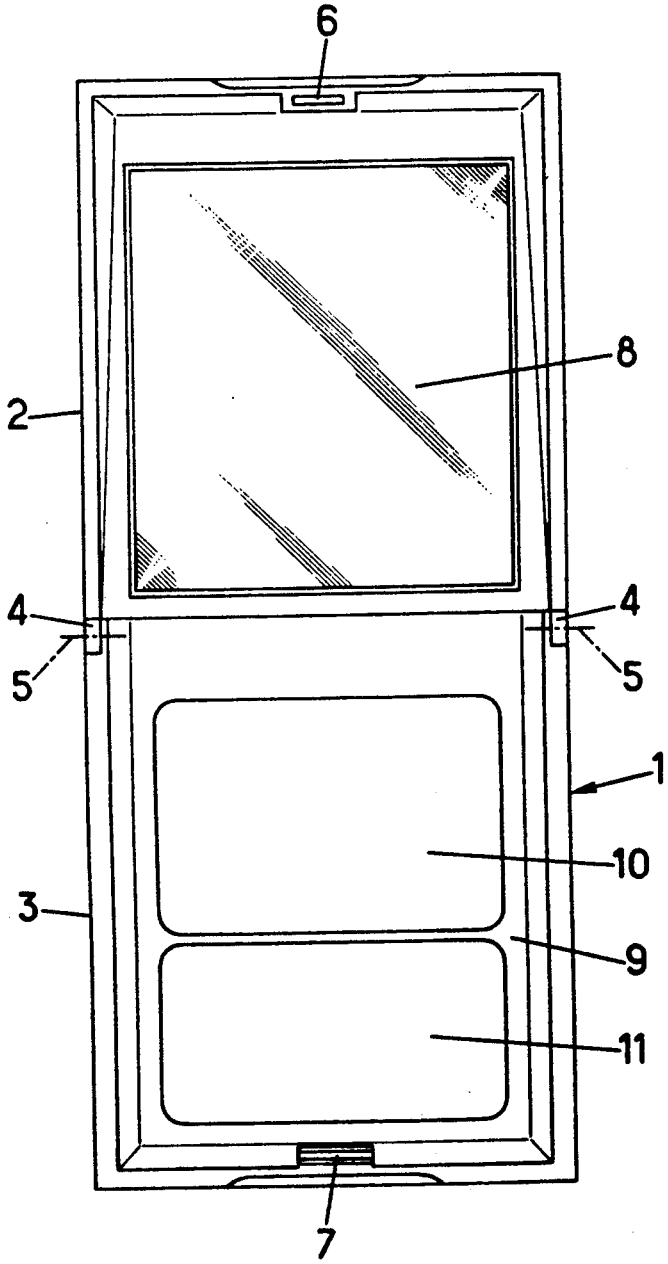
FIG. 2 shows a plan view of the box according to FIG. 1 open, the platform being in the position of use.

The make-up box as illustrated by FIGS. 1 and 2 comprises a flat case 1, having the general form of a parallelepiped, composed of a first part 2 and of a second part 3 having the general form of a rectangle, articulated one on the other along one of their ends. For this purpose, the first case part 2 has, at the two extremities of one of its ends two lugs 4 projecting perpendicularly to the general plane of the case part 2. Said two lugs 4 are articulated via two pins 5 on the second case part 3, near one end of said case part 3.

In the vicinity of their opposite end, the two case parts 2 and 3 are equipped with means 6 and 7 forming a fastener for the case. Said means forming a fastener are not shown in detail and described, since any known means for this purpose may be used.

According to FIG. 2, the first case part 2 has inside a mirror 8 and the second case part 3 has inside a platform 9 exhibiting two recesses 10, 11 for receiving two make-up products, for example compact powder of two different shades.

The case as described until now and illustrated in FIGS. 1 and 2 is of a type known per se.

Figure 3:
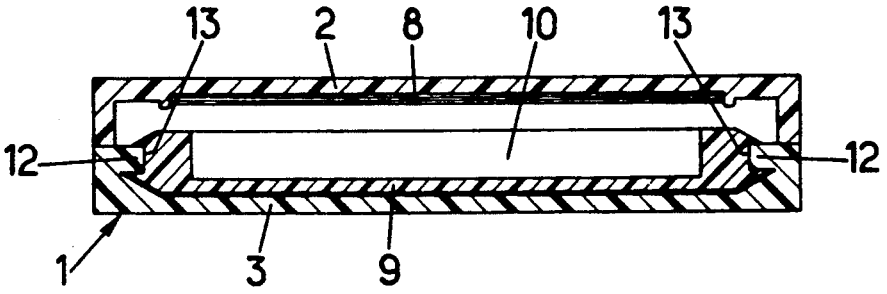
FIG. 3 is a transverse section of the box of FIG. 1.
Figure 4:
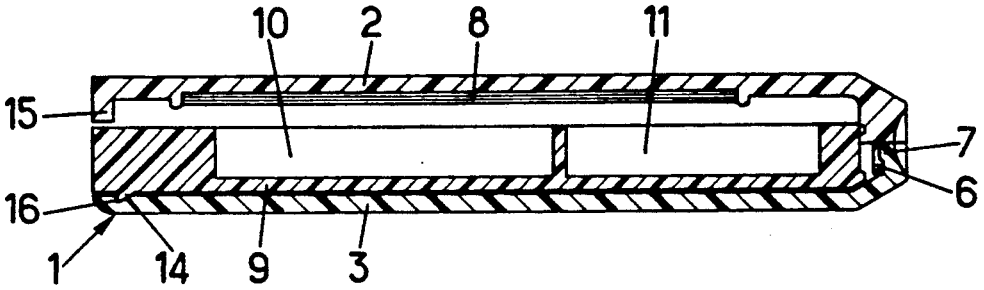
FIG. 4 is a longitudinal section of the box of FIG. 1.
Figure 5:
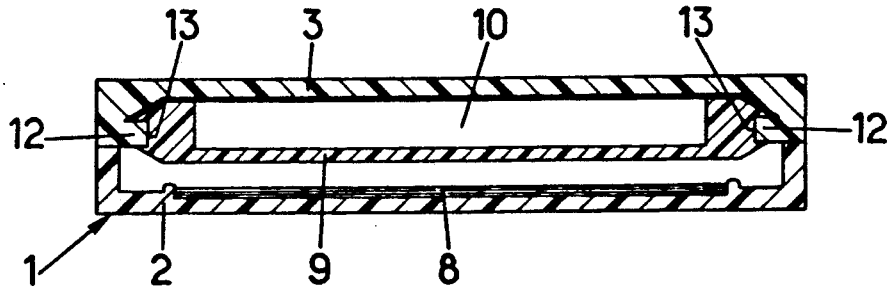
FIGS. 5 and 6 are sections similar to those of FIGS. 3 and 4 showing the platform in the position of display for sale.
Figure 6:
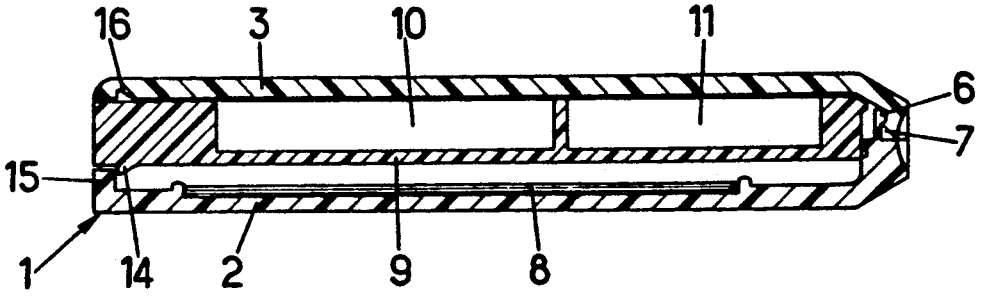

According to the invention, the platform 9, instead of being permanently fixed to the case part 3, as is customary, is linked to the case part 3 so as to be movable and rotatable through 180° so as to be able to occupy two positions such that the make-up products contained in the recesses 10 and 11 of the platform 9 may be exposed towards the case part 2 bearing the mirror 8 in a position called the position of use, according to FIGS. 3 and 4, and towards the case part 3 in a position called the position of display or presentation for sale, according to FIGS. 5 and 6. Moreover, the case part 3 is constructed so as to be transparent at least in the area covering the recesses 10 and 11 of the platform 9 in the position of presentation for sale.

Consequently, when the platform 9 is in the position of use, the make-up box according to the invention may be used in the same manner as the customary make-up boxes with a non-movable platform, that is to say, after opening the case, the user may check, in the mirror 8 secured to the case part 2 then forming the lid, the make-up work which she is undertaking with the aid of products taken from the platform 9 secured to the case part 3 then forming the bottom of the case.

By contrast, in the position of display for sale, the case part 2 to which the mirror 8 is secured serves as the bottom of the case and it is the at least partially transparent case part 3 which serves as the lid and makes it possible to see the contents of the recesses of the platform 9, that is to say the make-up products, without having to open the case.

As FIGS. 3 and 5 show, the case part 3 has inside two parallel guiding tongues 12 extending along the two opposite sides of the rectangular case part 3. The platform 9 exhibits externally two parallel guiding grooves 13 extending along its two opposite sides. The tongues 12 and the grooves 13 have complementary profiles such that the tongues 12 of the case part 3 may serve as gliding channels for the grooves 13 of the platform 9.

According to FIGS. 4 and 6, the two case parts 2 and 3 are cut into a bend on their end where they are articulated one on the other (lugs 4, pins 5), that is to say opposite the fastener 6, 7, in a manner such that the platform 9 may be introduced through said end into the closed case, by being guided on the tongues 12 of the case part 3, until they come into abutment against the fastener side of the case part 3.

Moreover, FIGS. 4 and 6 show that the platform 9 has at its rear end, that is to say the end opposite the fastener 6, 7 when the platform 9 is engaged in the case 1, at least one locking tooth 14 projecting over the lower face of the platform 9, that is to say the face opposite that towards which the make-up products contained in the recesses 10, 11 of the platform 9 are exposed. The tooth 14 has a sawtooth profile, with an inclined working flank forming a ramp in the direction of introduction of the platform 9 into the case 1 and with a non-working flank perpendicular to the direction of introduction.

In the position of presentation for sale according to FIG. 6, the tooth 14 of the platform 9 cooperates with a rear edge 15 of the case part 2, said edge 15 being orientated in a manner such that, when the case 1 is closed, it serves as an abutment for the tooth 14 and prevents the platform 9 from coming out of the case 1. When the case 1 is opened, the pivoting of the case part 2 in relation to the case part 3 about the pin 5 (FIG. 1) causes, as a result of the articulation of the case part 2 on the case part 3 via a pin (5) offset in relation to the case part 2 (articulation lugs 4), disengagement (towards the bottom of FIG. 6) of the edge 15, so that the latter frees the tooth 14. The platform 9 is then no longer immobilized in the case and may be pulled out from said case (to the left in FIG. 6).

When the platform 9 has been rotated through 180° and has been pushed into this position in the case 1 (FIG. 4), the tooth 14 becomes locked, when the platform 9 is pushed right into the case 1, in a locking hollow 16 provided in the case part 3, the platform 9 then being immobilized permanently in relation to the case part 3.

It should be pointed out that the embodiment described above and illustrated in the attached drawings has been given only by way of indicative, and non-limiting example and that various modifications and variants are possible within the scope of the invention.

In particular, the means for guiding the platform in one of the case parts may be composed of means other than the tongues 12 and grooves 13. The same applies in respect of the means for immobilizing the platform 9 in the case part 3, it being possible, for example, for said means to be made up of means for locking at the level of the tongues 12 and grooves 13, means which cooperate in releasable manner in the position of presentation for sale and preferably in non-releasable manner in the position of use of the platform in relation to the case part 3.

The two case parts 2, 3 and the platform 9 may advantageously be constructed by moulding in plastic material, it being possible for the case part 3 to be constructed of a transparent material either solely in the area of the recesses 10, 11 of the platform 9, or in its entirety. In the latter case, the area of the case part 3 situated outside the recesses 10, 11 of the platform 9 may be made opaque by any appropriate means.

To facilitate pulling out the platform from the case part 3 in the position of display for sale, it is possible, for example, to provide a slot at the rear of the platform 9, or a push button at the front of the platform 9 or on the case part 3.

What is claimed is:

1. A make-up box comprising:

a case constructed of two case parts, a first case part and a second case part, said parts being hinged one to the other along a pivot axis, wherein when said case is in a closed position an inside of said first case part is facing an inside of said second case part;

a mirror disposed in said first case part; and a platform including two faces opposite one another, said platform bearing at least one make-up product on a first face of said two faces, said platform being disposed in said second case part, said second case part being at least partially transparent, said second case part and said platform being configured so as to permit said platform to occupy one of two alternate positions in said second case part when said case is in said closed position, such that make-up products borne by said platform face towards said second case part in a first position of said two alternate positions and face towards said first case part in a second position of said two alternate positions.

2. A make-up box according to claim 1, in which said platform and said second case part include cooperative means for rectilinear guidance of said platform in said second case part.

3. A make-up box according to claim 2, in which the said cooperative means for rectilinear guidance comprise tongues and grooves.

4. A make-up box according to claim 2, in which said platform and said case comprise means for immobilizing said platform in relation to said case.

5. A make-up box according to claim 2, in which said platform and said case comprise means for locking said platform in a fixed position in relation to said case.

6. A make-up box according to claim 2, in which said platform and said case comprise locking means for releasable immobilization of said platform when said platform is disposed in said first position and for non-releasable immobilization of said platform when said platform is disposed in said second position.

7. A make-up box according to claim 1, in which said platform and said case comprise guidance means including tongues and grooves for rectilinear guidance of said platform in said second case part, said guidance means extending from a hinge side of said second case part towards an edge opposite said hinge side of said second case part.

8. A make-up box according to claim 7, wherein said platform and said case include means for immobilizing said platform relative to said case comprising a locking mechanism releasable by opening said case when said platform is in said first position.

9. A make-up box according to claim 8, in which the said locking mechanism comprises a projection on a second face of said faces of said platform and a means for engaging said projection on said first case part.

10. A make-up box according to claim 1, wherein said case is comprised of means on said case for facilitating the removal of said platform from said case when said platform is in said first position.

11. A make-up box according to claim 1, wherein said platform is comprised of means on said platform for facilitating removal of said platform from said case when said platform is in said first position.

12. A make-up box comprising:

a case constructed of two case parts, a first case part and a second case part, said parts being hinged one to the other along a pivot axis, wherein when said case is in a closed position an inside of said first case part is facing an inside of said second case part;

a mirror disposed in said first case part; and a platform including two faces opposite one another, said platform bearing at least one make-up product on a first face of said two faces, said platform being disposed in said second case part, said second case part being at least partially transparent, said second case part and said platform being configured so as to permit said platform to occupy one of two alternate positions in said second case part when said case is in said closed position, such that make-up products borne by said platform face towards said second case part in a first position of said two alternate positions and face towards said first case part in a second position of said two alternate positions, said platform and said second case part include tongues and grooves for rectilinear guidance of said platform in said second case part, said grooves extend from a hinge side of said second case part towards an opposite edge of said second case part, said platform and said second case part include a locking mechanism constructed so as to allow immobilization of said platform in said case when said case is in said closed position releasable by opening of said case when said platform is in said first position and non-releasable immobilization of said platform in said case when said platform is in said second position.

13. A make-up box according to claim 12, in which the said locking mechanism is comprised of a projection on a second face of said platform and a means for engaging said projection on said first case part. facilitating removal of said platform from said case when said platform is in said first position.

14. A make-up box comprising:

a substantially parallelepiped-shaped case including a first and a second substantially rectangular flat case part hinged together along one of their edges;

a mirror secured inside said first case part; and a substantially rectangular flat platform having two opposite faces with at least one recess for receiving at least one make-up product provided on a first of said two opposite faces, said second case part being at least partially transparent and said platform and said second case part comprising complementary means arranged for allowing said platform to be received in said second case part in one of two alternate positions when said case in is in a closed position, both in a first position in which said first face of said platform is facing said second case part, said make-up products thus being visible through said at least partially transparent second case part, and after removal from said second case part and rotation through 180° about an axis contained in the plane of said platform, in a second position in which said first face of said platform is facing said first case part when said case is closed.

15. A case including a first case part and a second case part pivotally connected to said first case part, wherein said first case part and said second case part each have an inside surface such that when said case is in a closed position said inside surfaces face each other, wherein said inside surface of said first case part is substantially covered by a mirror, wherein said second case part includes a support structure; and a platform including a first side and a second side opposite said first side, said first side having a means for bearing a make-up product, wherein said platform includes a means for engaging said support structure in one of two positions when said case is in said closed position, in a first of said two positions said first side of said platform faces said inside surface of said second case part and in a second of said two positions said first side of said platform faces said mirror, wherein said second case part is partially transparent such that when said platform is mounted in said first of said two positions at least a part of said first side of said platform bearing said make-up product is observable through said second case part.

16. A case according to claim 15, wherein said means for engaging comprises a tongue on said platform which cooperatively engages with a groove of said support structure.

17. A case according to claim 16, wherein said means for engaging further comprises a projection on said platform which is cooperatively engaged with said first case part to prevent said platform from being disengaged from said case, when said platform is at said first of said two positions and said case is in said closed position.

18. A case according to claim 16, wherein said platform is introduced into said support structure from a hinge side of said case.

19. A case according to claim 15, wherein said means for engaging comprises two opposite tongues on said platform which cooperatively engages with two opposite grooves of said support structure.

20. A case according to claim 15, wherein said second case part being transparent includes at least an area corresponding to a surface area of said first side of said platform bearing make-up product.

* * * * *